US006823648B2

(12) United States Patent
Holter

(10) Patent No.: US 6,823,648 B2
(45) Date of Patent: Nov. 30, 2004

(54) MEDIA DISC PACKAGING APPARATUS AND METHOD

(75) Inventor: Carl F. T. Holter, Waukesha, WI (US)

(73) Assignee: Puzzleworks LLC, Waukesha, WI (US)

( * ) Notice: Subject to any disclaimer, the term of this patent is extended or adjusted under 35 U.S.C. 154(b) by 11 days.

(21) Appl. No.: 09/990,665

(22) Filed: Nov. 21, 2001

(65) Prior Publication Data

US 2003/0093978 A1 May 22, 2003

(51) Int. Cl.[7] ..... B65B 43/26

(52) U.S. Cl. ..... 53/254; 53/381.1; 53/382.2; 414/411; 414/797

(58) Field of Search ..... 53/467–469, 457, 53/482, 55, 254, 381.1, 382.1; 414/411, 797

(56) References Cited

U.S. PATENT DOCUMENTS

| | | | | | |
|---|---|---|---|---|---|
| 3,896,606 | A | | 7/1975 | Utsumi | |
| 4,300,331 | A | | 11/1981 | Yoshiba | |
| 4,365,458 | A | | 12/1982 | Palmer | |
| 4,551,966 | A | | 11/1985 | Aoyagi | |
| 4,949,526 | A | * | 8/1990 | Brogna et al. | 53/306 |
| 5,285,620 | A | | 2/1994 | Kaye et al. | |
| 5,664,405 | A | | 9/1997 | Perego | |
| 5,694,743 | A | | 12/1997 | Beighle | |
| 5,713,463 | A | | 2/1998 | Lakoski et al. | |
| 5,788,114 | A | | 8/1998 | Perego | |
| 5,816,028 | A | | 10/1998 | Zaniboni | |
| 5,890,346 | A | | 4/1999 | Guess | |
| 5,943,845 | A | | 8/1999 | Ilsemann | |
| 6,021,894 | A | | 2/2000 | Lakoski et al. | |
| 6,048,158 | A | | 4/2000 | Zaniboni | |
| 6,068,117 | A | | 5/2000 | Koehn | |
| 6,367,231 | B1 | * | 4/2002 | Yamamoto | 53/469 |
| 6,397,564 | B1 | * | 6/2002 | Yamamoto | 53/473 |
| 6,418,703 | B1 | * | 7/2002 | Yamamoto | 53/564 |
| 6,527,500 | B1 | * | 3/2003 | Gelardi et al. | 53/468 |
| 6,536,194 | B2 | * | 3/2003 | Minardi | 53/567 |

* cited by examiner

*Primary Examiner*—Stephen F. Gerrity
*Assistant Examiner*—Michelle Lopez
(74) *Attorney, Agent, or Firm*—Michael Best & Friedrich LLP

(57) ABSTRACT

In some preferred embodiments of the media packaging apparatus and method according to the present invention, a plurality of stations are positioned adjacent to a conveyor. A disc case enters a feed path preferably from an empty disc case receptacle, is conveyed to a disc case opening station where a wedge separates the lid from the housing of the case, is then conveyed to a media disc insertion station where a media disc is inserted in the case, and is then conveyed to a case closing station where the case is closed. Other additional stations are possible such as an additional item insertion station or a disc case unloading station. The functions performed at the various stations can alternatively be performed at the same location along the conveyor. In some embodiments, the present invention is equipped with a drive system that can be operated in the absence of power.

40 Claims, 7 Drawing Sheets

MEDIA DISC PACKAGING APPARATUS AND METHOD

FIELD OF THE INVENTION

The present invention relates generally to packaging devices and methods, and more particularly to devices and methods for packaging media discs.

BACKGROUND OF THE INVENTION

A large number and variety of media disc packaging machines and devices are known in the art. A primary object of many of these machines and devices is to package disc media into individual cases, boxes, containers, and the like. In one common application for example, compact discs (whether containing music, computer programs, or other data) are packaged into clamshell-type cases, often called "jewel cases". Other types of flat media packaged in cases, boxes, and other containers include mini-discs, magnetic discs, DVD discs, and the like. These discs are typically flat and thin, and can be round, square, or can take any other shape. With the increased use of such media worldwide, the demand for faster, more efficient, and less expensive packaging machines and devices continues to rise. However, despite numerous developments in media disc packaging technology embodied in conventional machines and devices, several problems still exist.

Media disc packaging machines capable of faster and more efficient operation are in increasing demand. However, a number of conventional media disc packaging machines are either incapable of operating at relatively high speeds or do so at the expense of device complexity and/or efficiency.

In addition, existing packaging machines are typically large and complex, with many points that are not easily accessible. Due to the large and complex nature of these machines, they can be quite expensive and difficult to manufacture, assemble, and maintain. Also, changeovers and maintenance operations on such machines can take a significant amount of time. Accordingly, these machines do not normally meet the desires of many users seeking a relatively inexpensive packaging machine that requires minimal readjustment during changeovers and that can provide extended, uninterrupted periods of production.

Additionally, it is often highly desirable for packaging machinery to be as small as possible (and in some cases even portable). Another valuable feature is the ability to operate the machinery in the absence of electrical power. Unfortunately, these features have not been important design considerations for most conventional disc packaging machines.

Another limitation of many conventional media disc packaging machines is the manner in which such machines perform disc packaging functions. To insert a media disc into a disc case, many machines employ dedicated moving assemblies that are often complex, expensive, and slow. Because a fraction of a second per disc can significantly affect the output of a media disc packaging machine, these assemblies can represent a bottleneck in machine speed and can greatly impact machine profitability.

Most conventional media disc packaging machines are also not designed or are not wellsuited for relatively small packaging runs, such as those of small volume companies and smaller media producers and publishers. Generally, most media disc packaging mechanisms are designed for large packaging arms, and are far too expensive for companies not in the packaging business. Thus, these machines are not designed with the needs of many individuals and companies in mind.

In light of the problems of conventional media disc packaging machines and methods, a need exists for a simple, compact, reliable, and inexpensive media packaging machine. In some embodiments, such a machine would be portable. Also in some embodiments, the machine can preferably operate without electrical power. Each of the preferred embodiments of the present invention offers one or more of these advantages and results.

SUMMARY OF THE INVENTION

The present invention provides an apparatus and method for packaging media discs. Some preferred embodiments of the present invention employ at least one conveyor, an inclined case opening surface for opening the case, one or more pick and place mechanisms for loading the open case, and a closing mechanism or manner in which the loaded case is closed.

Several embodiments of the present invention are possible. A number of preferred embodiments have one or more conveyors creating a feed path with one or more stations adjacent to the feed path. The term "station" encompasses the necessary equipment to perform a certain task, such as opening a disc case, closing a disc case, or inserting an object into the disc case. Preferred embodiments of the present invention various combinations of the following stations: an empty disc case retaining station, a disc case opening station, a disc insertion station, a disc case closing station, a disk case unloading station, and an additional item insertion station. Two or more stations can be at the same location in various embodiments of the present invention.

If the stations are positioned at separate locations along a feed path, at least one conveyor is preferably employed to move the disc cases from station to station. In some embodiments, the conveyor includes a rotary table. In some highly preferred embodiments (such as rotary table embodiments), an indexing ring positioned on the table is used to sequentially move the disc cases from one station to another. Guide rails can be employed to hold the case open and/or to move the case toward a closed position. In addition, a conveyor can be used to move the disc cases from the empty disc case retaining station to another conveyor which to move the disc cases to one or more other stations.

Discussing each station more specifically, the empty disc case retaining station preferably uses a receptacle to facilitate the supply of a continuous stream of cases to the feed path. Preferably, a magazine is used to perform this function.

The disc case opening station preferably uses at least one inclined surface (relative to the case to be opened) or wedge to open the disc cases. The inclined surface or wedge opens the case by causing a separation between the lid and the housing of the disc case. The term "inclined surface" includes one or more surfaces, regardless of size or degree of slope. By way of example only, this surface can be defined by line contact (or even point contact) of the case upon the inclined surface as the case is wedged open. In some embodiments of the present invention, an adjustable wedge is employed for providing different angles and positions of contact with disc cases. Also, in some embodiments of the present invention, an inclined surface can be defined on the case (such as at the lid/housing interface of the case) for being forced upon by a non-inclined surface to cause separation of the case.

A number of different disc grasping or manipulation elements can be used to insert discs into the opened cases.

In some preferred embodiments, the disc insertion station has an arm with a grasping head to pick up the media disc and to place, drop, or otherwise insert it into the case. One embodiment uses a vacuum cup to grasp the disc.

The disc case closing station can take several forms. One embodiment uses at least one roller to close the disc case. Another embodiment uses at least one guide rail to close the case. Yet another embodiment uses both a guide rail and a roller to close the case.

The disc case unloading station also can take multiple forms. For example, pick and place arms can be used to unload cases, cases can be dropped from an end of the conveyor, or cases can be dropped through an aperture in a floor of the apparatus (e.g., in the floor of the rotary table).

One advantage of the present invention is that the apparatus embodying the invention can be easy to manufacture, assemble, and maintain. The apparatus can therefore be relatively inexpensive. Another advantage of the present invention is that it can be made compact and easy to use. In some embodiments, the machine's relatively small footprint facilitates easier access to various loading and unloading points of the machine. Also, the streamlined design can employ fewer moving parts than most conventional packaging machines, thereby making the machine easier to use and adjust (if necessary).

Yet another advantage is that machines embodying the present invention can be designed to be easily transported. For a number of reasons, a number of embodiments of the present invention are ideal for those who want a machine that is portable. First, machines according to such embodiments can be manufactured to be relatively light in weight. Second, machines according to such embodiments can have a relatively small footprint, thereby also making the machine easier to move. Finally, some embodiments of the machine can operate without electrical power.

Still another advantage of the present invention is that some machines embodying the present invention can be easily adapted for smaller production runs while being capable of performing large production runs. In some preferred embodiments, machines according to the present invention can easily be adapted for smaller production runs because a changeover can be performed quickly, with little to no set-up time needed.

More information and a better understanding of the present invention can be achieved by reference to the following drawings and detailed description.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. In the drawings, wherein like reference numerals indicate like parts.

DETAILED DESCRIPTION OF THE PREFERRED EMBODIMENTS

Figure 1:
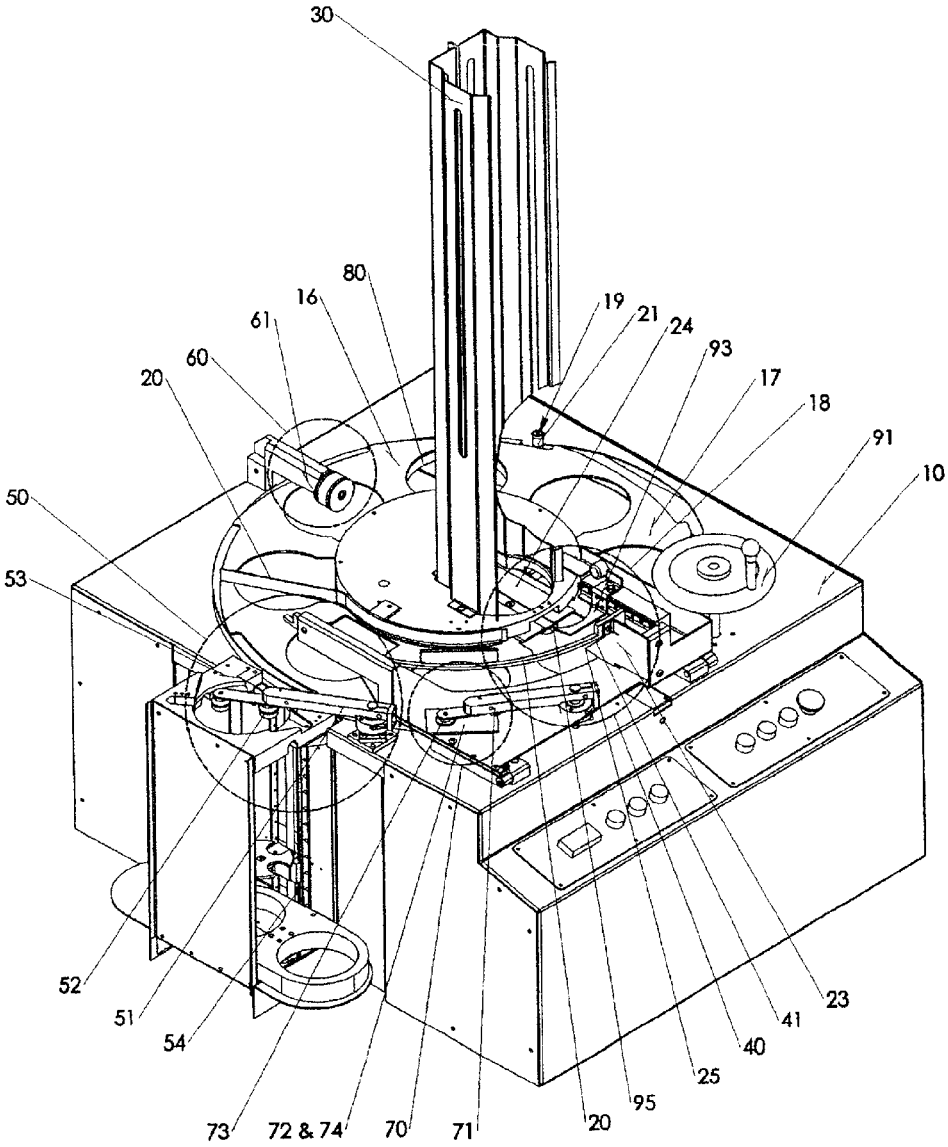
FIG. 1 is a perspective view, partially sectioned, of a media disc packaging apparatus according to a preferred embodiment of the present invention.
Figure 2:
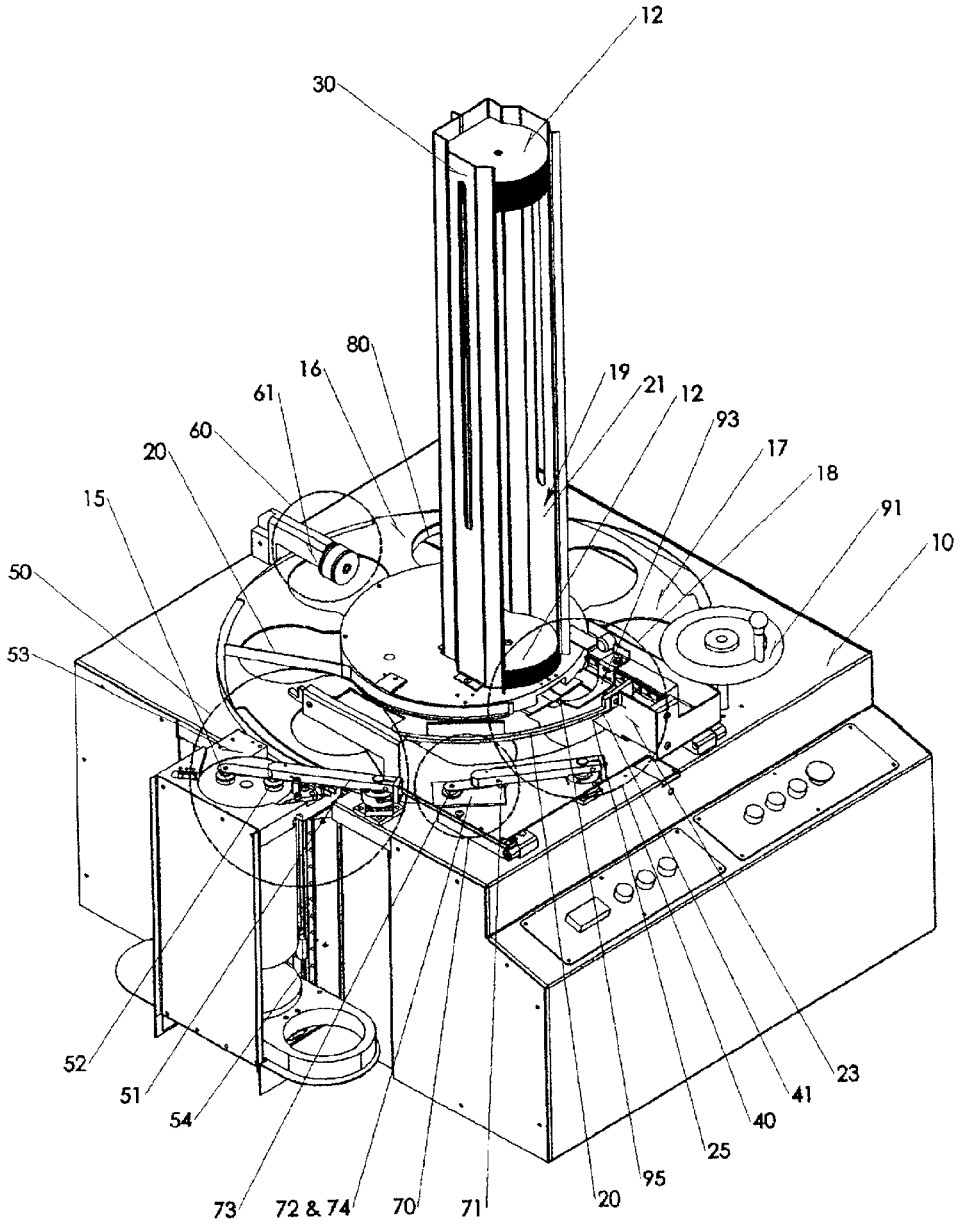
FIG. 2 is a perspective view of the media disc packaging apparatus illustrated in FIG. 1, shown with media disc cases, media discs, and other case inserts loaded in the apparatus.
Figure 3:
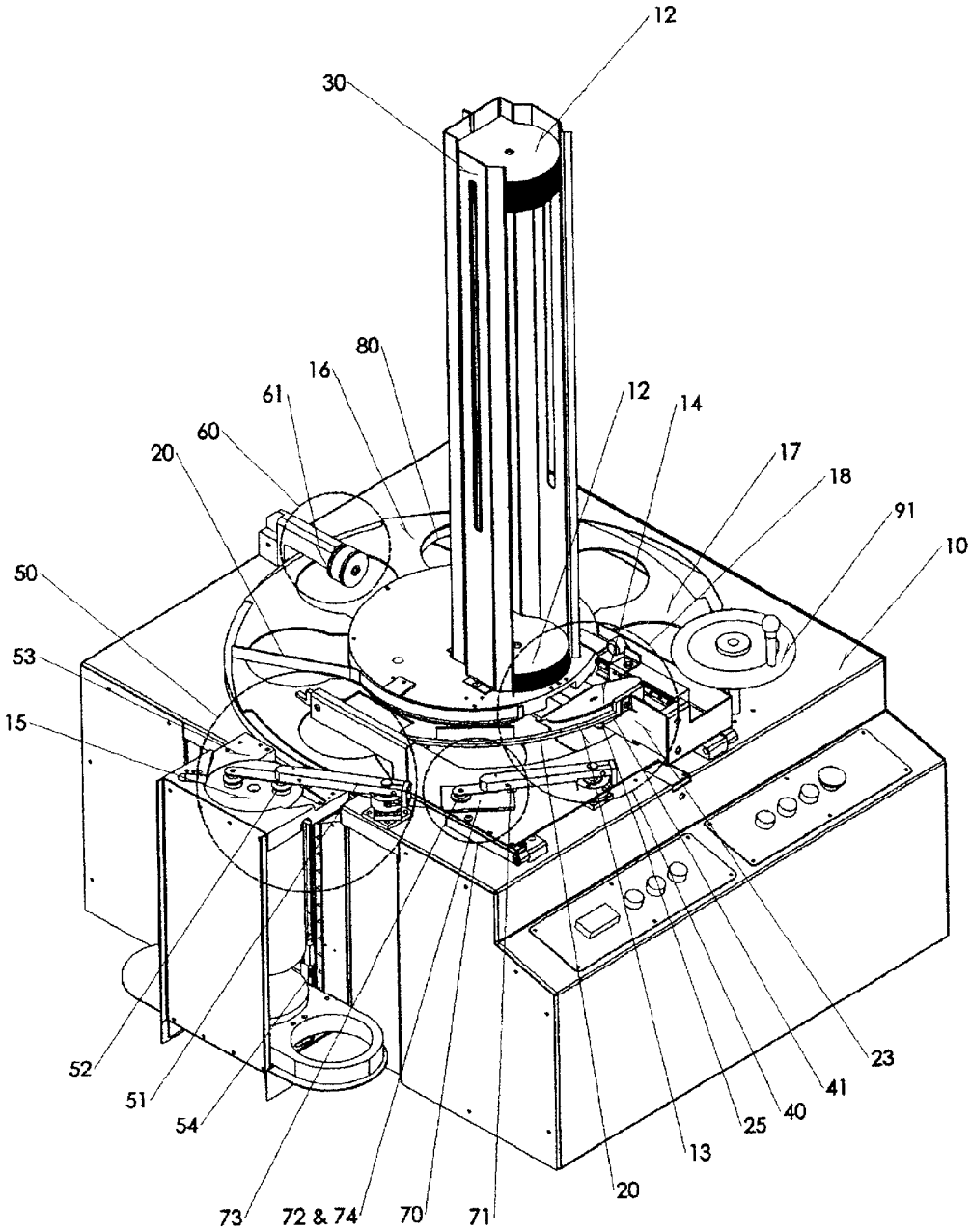
FIG. 3 is a perspective view of the media disc packaging apparatus illustrated in FIGS. 1 and 2, shown with a media disc case being opened.
Figure 4:
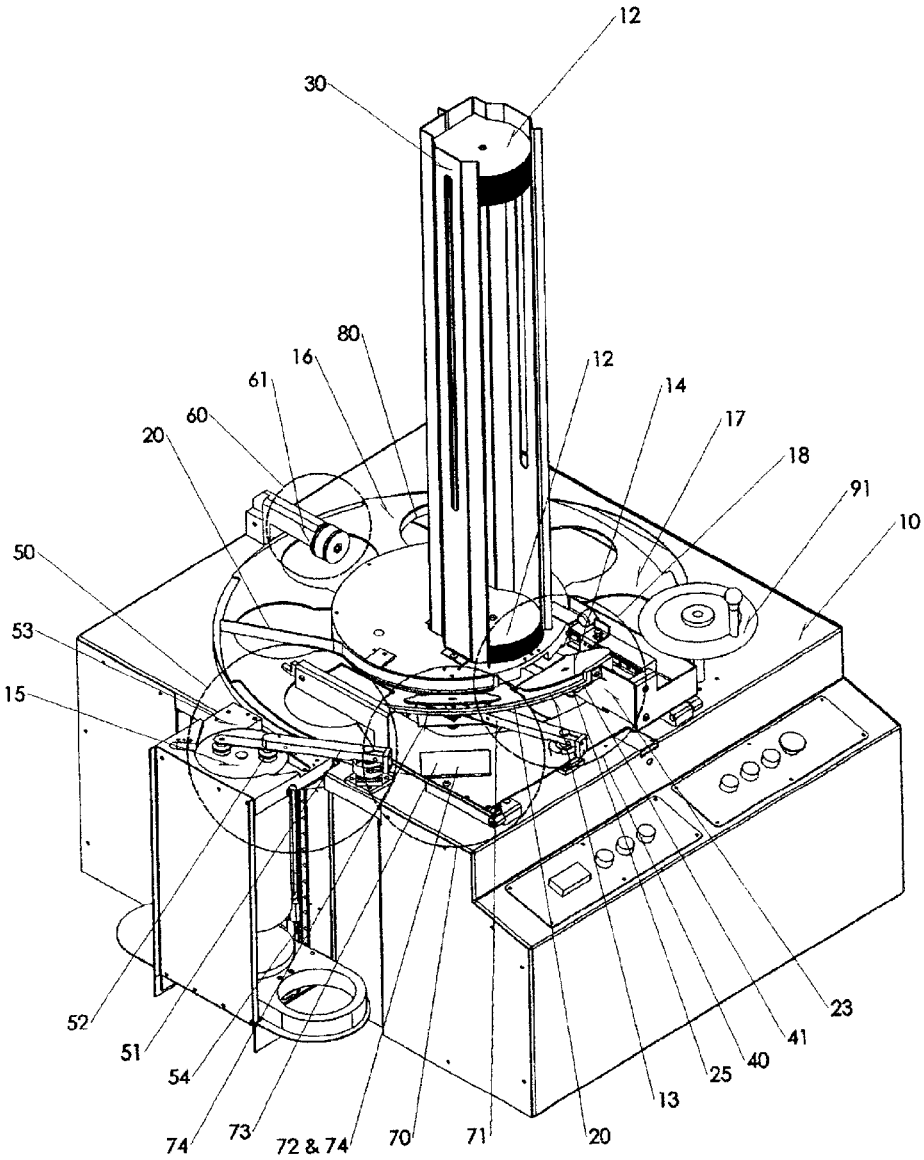
FIG. 4 is a perspective view of the media disc packaging apparatus illustrated in FIGS. 1–3, shown with an insert being inserted in an open media disc case.
Figure 5:
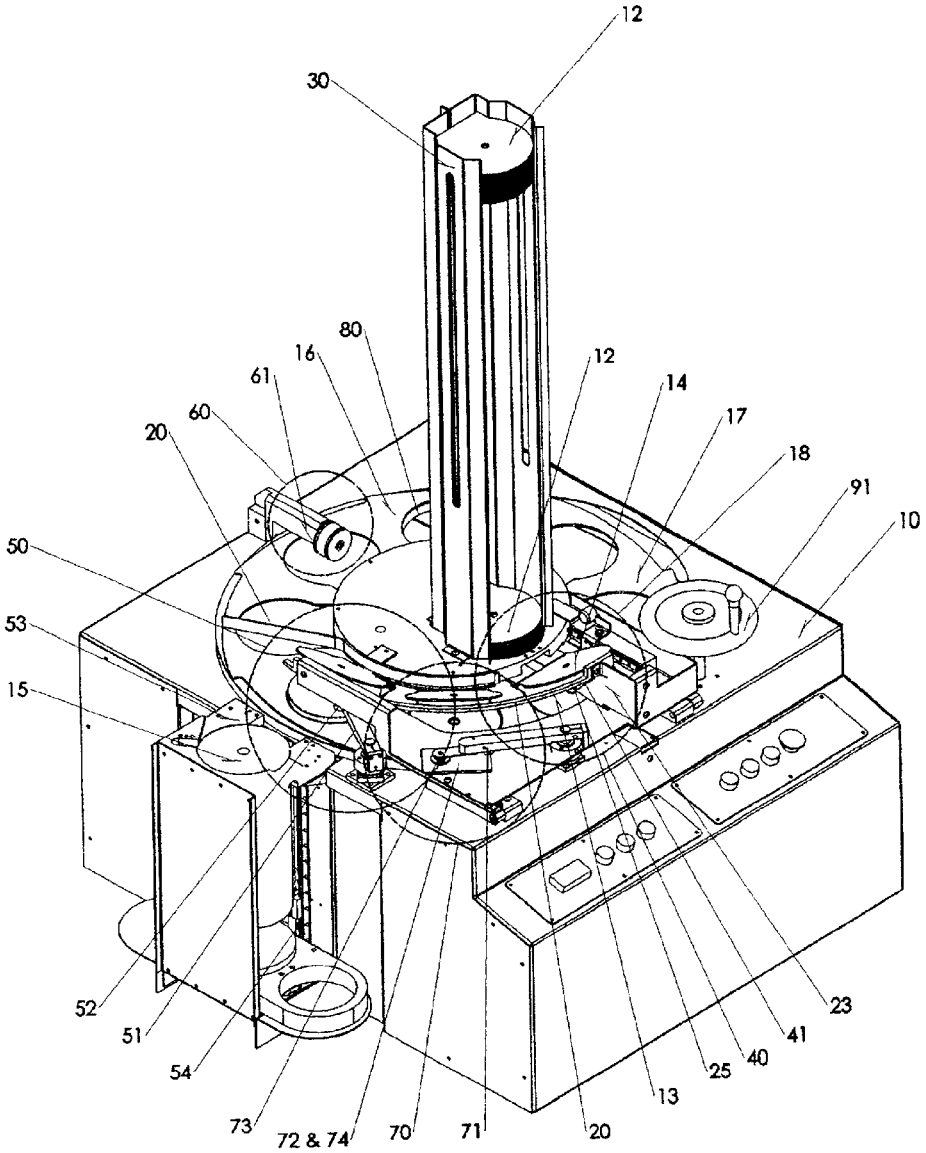
FIG. 5 is a perspective view of the media disc packaging apparatus illustrated in FIGS. 1–4, shown with a media disc being inserted in an open media disc case.
Figure 6:
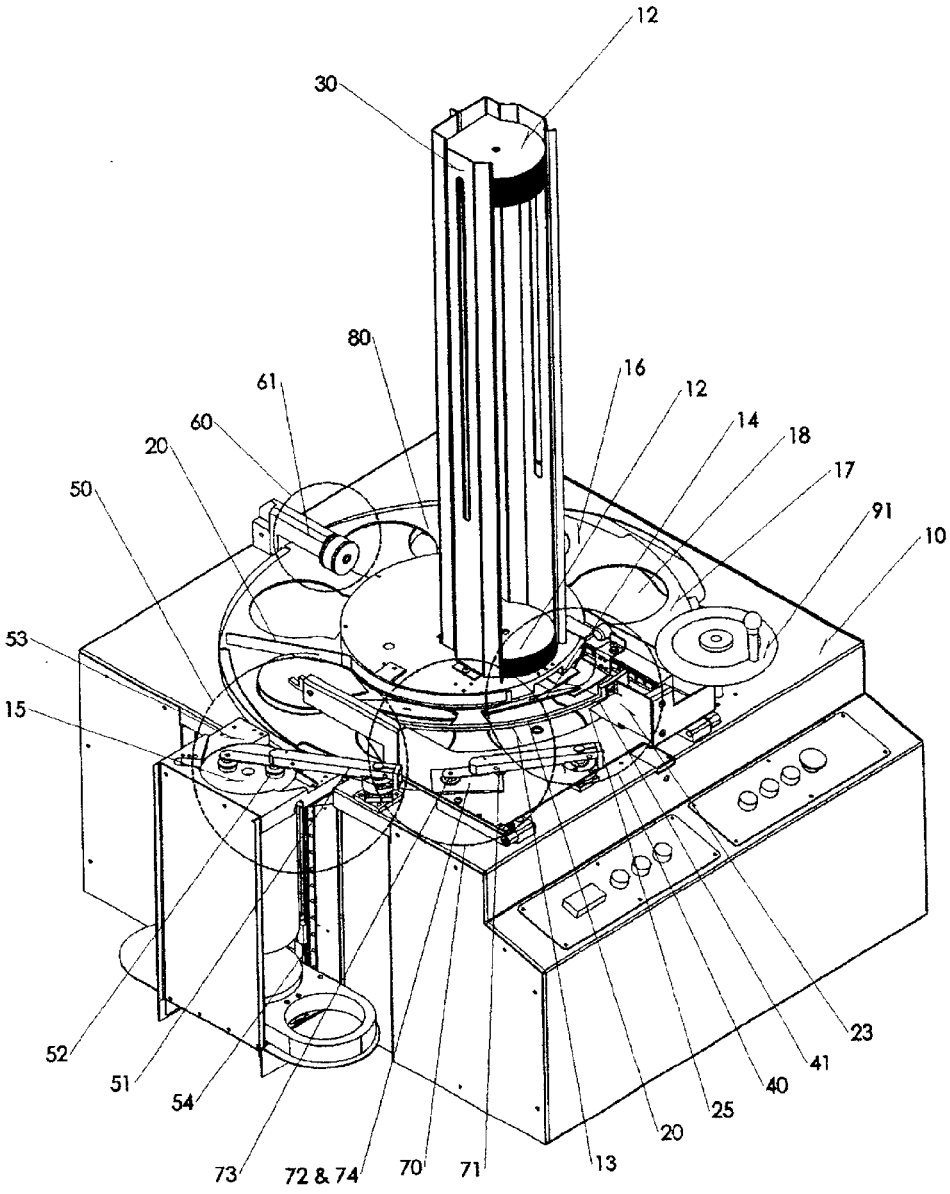
FIG. 6 is a perspective view of the media disc packaging apparatus illustrated in FIGS. 1–5, shown with a media disc case being closed.
Figure 7A:
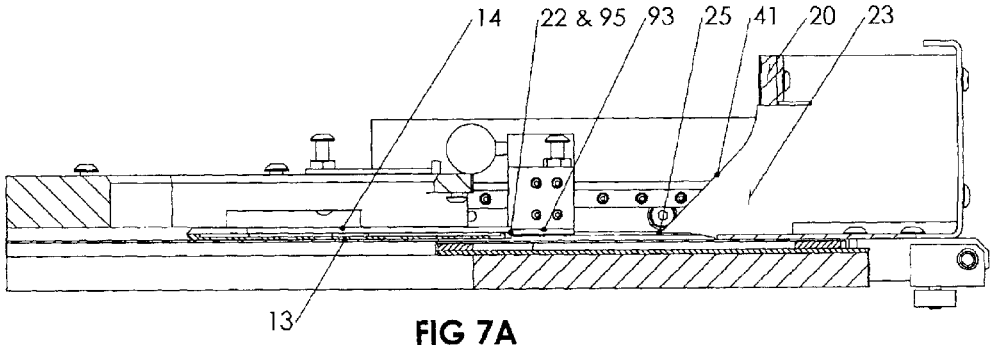
FIGS. 7A–7C are side elevational views of the disc case opening station illustrated in FIGS. 1–6, shown with a media disc case at different stages of being opened.
Figure 7B:
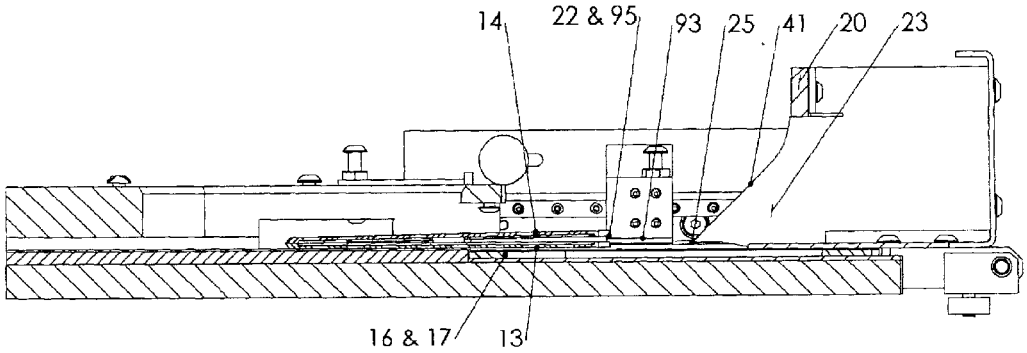
Figure 7C:
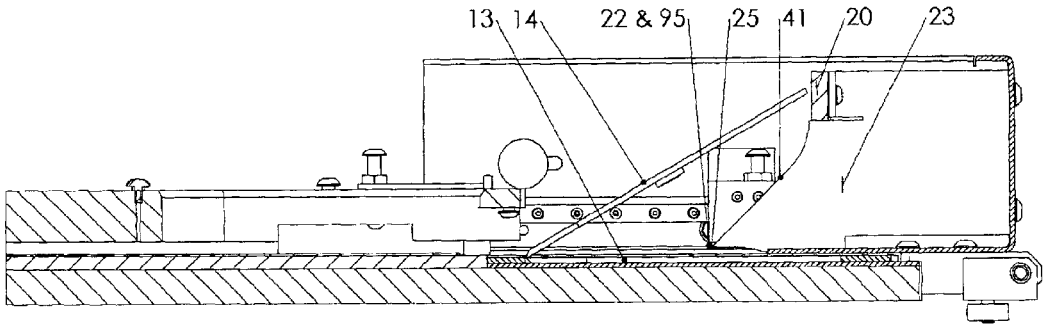

As shown in FIGS. 1–6, the packaging apparatus 10 preferably has one or more stations positioned adjacent to a conveyor 16 in order to insert media discs 15 (and possibly other items as will be described in greater detail below) into media disc cases 12. The conveyor 16 moves the cases along a feed path to one or more locations in the machine where operations are performed, such as for case opening, disc inserting, and case closing operations. In some embodiments, the conveyor 16 (or part of the conveyor) also holds the cases 12 in place as they are moved and/or as operations are performed. The conveyor 16 can be any material handling conveyor capable of moving disc cases 12 along a feed path. By way of example only, the conveyor can be a belt conveyor, a paddle conveyor, a table top conveyor, a chain conveyor, an ejector mechanism, any pushing mechanism, any conventional actuator (e.g., a solenoid, hydraulic or pneumatic cylinder, and the like), a magnetic rail and carriage assembly, a rack and pinion assembly, a reciprocating shuttle, an indexing finger, an indexing ring, and the like.

In one highly preferred embodiment illustrated in the figures by way of example only, the conveyor 16 is a rotary table with apertures 18 therein to receive and retain the cases 12, such as the one illustrated in different stages of a packaging process in FIGS. 2–7. Other embodiments can use receptacles, recesses, or holes in the conveyor 16 in place of the apertures 18. Preferably, the rotary table 16 has an indexing ring 17 attached to it to sequentially move the rotary table 16 and the disc cases 12 therein from one station to another. A drive shaft 19 with an indexing roller 21 (both visible in the sectioned view of FIG. 1) can engage the indexing ring 17 to propel the rotary table 16. Other preferred methods to drive the indexing ring 17 include a central motor shaft connected to the center of the indexing ring 17, or a roller, pinion, belt, chain, cable or other driving element driving any inside or outside surface (e.g., teeth, a recess or channel, series of apertures, and the like) of the indexing ring 17, whether directly or through one or more drive gears or other power transmission elements or devices. Other embodiments that use non-rotary conveying devices can have element(s) functioning in a manner similar to the above-described indexing ring 17 (such elements moving cases in non-rotary manners). In this regard, the machine layout need not be circular as illustrated in the figures, but can instead have any shape or path desired (i.e., a curved or arcuate path, a straight path, a path through which cases are transported up and down or to different levels in the apparatus 10, and the like).

Among the plurality of possible stations positioned along a feed path defined by the path through which disc cases move through the apparatus 10, preferably there is at least a disc case opening station 40 and a media disc insertion station 50 to package media discs into the cases 12. One or more additional stations can be positioned along and/or adjacent to the conveyor 16, if desired. These stations include an empty disc case receptacle 30, an additional item insertion station 70, a disc case closing station 60, and a disc case unloading station 80. The insertion stations 50 & 70 can be positioned anywhere along the feed path so long as their operations take place after the case is opened and before the case is closed. Although the stations can be located at different points along the conveyor 16 as illustrated in FIGS. 1–6, two or more stations (and even all stations) can be at the same location or substantially the same location along the conveyor 16. By way of example only, the conveyor 16 can be defined by an ejector mechanism that ejects discs from a empty disc case receptacle 30, while one, more, or all of the other stations can be located in a position to which the ejector mechanism ejects the disc cases. Each of the stations will be discussed more specifically below.

The empty disc case receptacle 30 can have many different forms such as a walled structure or an area defined by rods, a frame, chute, a stack of cases, and the like. Regardless of structure, this station is preferably capable of receiving and more preferably receiving and orienting empty disc cases 12 prior to entering the feed path. The structure defining the empty disc case receptacle 30 can be made of any suitable material, including but not limited to metal, plastic, wood, ceramic, and composites. Most preferably, this structure is made of aluminum, steel, or some other metal.

In some preferred embodiments, the empty disc case receptacle 30 is a magazine shaped to gather and orient the cases 12. The empty disc case receptacle 30 preferably has a shape similar to a silhouette of the cases 12. Preferably, the magazine is tall enough to hold a number of cases, such as at least fifty cases (a common number in which cases are sold). The empty disc case receptacle 30 is preferably gravity fed, with the cases 12 exiting through the bottom thereof. However, other feed systems are possible, such as a vertical lift system, wherein cases enter the feed path from above or below the empty disc case receptacle 30. For example, the empty disc case receptacle 30 can be located above the conveyor 16 for dropping disc cases 12 onto the conveyor 16 or for permitting discs to be pulled from the empty disc case receptacle 30 by the conveyor 16, can be located beneath the conveyor 16 for lifting disc cases 12 (under force from one or more springs, actuators, or other biasing or driving elements) through an aperture 18 in the conveyor 16, can be located beside and below the conveyor 16 for lifting disc cases 12 in a similar manner to a position where they can be laterally ejected to the conveyor 16 by an ejector mechanism, and the like.

Another possible location and orientation for the empty disc case receptacle 30 is shown in FIG. 1. In this embodiment, the empty disc case receptacle 30 is not located above the conveyor 16. This embodiment uses a second conveyor 24 to deliver the disc cases 12 from the empty disc case receptacle 30 to the conveyor 16. Preferably, this second conveyor 24 is a piston or solenoid- operated ejector that pushes a case 12 out of the empty disc case receptacle 30 through an opening large enough for a single disc case 12 to pass through. The second conveyor 24 in FIGS. 1–6 is illustrated as a carriage that is driven in a reciprocating manner toward and away from the wedge 23 by a piston or solenoid (not shown) connected to the carriage. The second conveyor 24 preferably pushes the case 12 until it is on the conveyor 16. In some highly preferred embodiments such as that shown in FIGS. 1–7, the disc case 12 cannot be seated or otherwise is not fully received upon the conveyor 16 until it contacts an inclined opening surface 41 (described in greater detail below). Although the illustrated preferred embodiment uses an ejector, any conventional conveyor as discussed in relation to the conveyor 16 that is capable of moving cases 12 toward the inclined surface 41 and forcing the cases 12 against the inclined surface 41 can be used.

In some preferred embodiments, a case 12 is conveyed by one of the two conveyors 16, 24 to a disc case opening station 40. Preferably, as the case 12 approaches the disc case opening station 40, an area defining an interface of the case lid 14 and housing 13 engages the inclined surface 41. The inclined surface 41 forces the lid 14 to separate from the housing 13 responsive to the lid/housing interface being forced against the inclined surface 41.

In some preferred embodiments, the inclined surface 41 is a surface of a wedge 23 defined by a plate, block, box, or other element, wherein the inclined surface 41 faces generally in a direction toward cases 12 approaching from the empty disc case receptacle 30. In other words, such wedge-shaped elements preferably have a surface 41 that is inclined at an acute angle away from the approaching cases 12. Alternatively, the wedge 23 can be defined by one or more rods, bars, plates, or fingers providing a surface or a collective inclined surface upon which the case 12 can be pressed to open the case 12. The wedge 23 can be constructed from sheets of material (e.g., sheet metal, fiberglass or plastic plates, etc.), from wire or bar stock, can be injection-molded, stamped, pressed, or extruded, can be assembled from multiple elements connected together in any conventional manner, and the like. The wedge 23 and the inclined surface 41 thereof are preferably made of a material of sufficient strength so that they are resistant to wear and will not warp, bend, or break during operation. Such materials include metal, plastic, wood, ceramic, and composites.

Depending at least partially upon the shape of the case 12 being opened and the shape of the interface between the lid 14 and housing 13 of the case 12, it may be desirable to initiate separation of the lid 14 from the housing 13 by one or more elements that contact the case 12 prior to reaching the wedge 23. Although such elements are not required in many applications of the present invention, they can be used to separate cases that require more force to separate or are otherwise more difficult to wedge open with the wedge 23. One such element is illustrated in the figures by way of example only. Specifically, a case separator 93 can be mounted to contact approaching cases 12 as they leave or otherwise travel away from the empty disc case receptacle 30. The case separator 93 can be a plate, bar, finger, or other element mounted in a conventional manner to a frame or body of the disc packaging apparatus 10. In the illustrated preferred embodiment, the case separator 93 is a relatively thin and flat plate.

The case separator 93 can be rigidly attached to a frame of the disc packaging apparatus 10 by one or more screws, rivets, nails, or other conventional fasteners, by brazing or welding, by adhesive or cohesive bonding material, or in any other manner desired. The case separator 93 can even be integral with the frame of the disc packaging apparatus 10. In other embodiments such as the one shown in the figures, the case separator 93 can be mounted to move with respect to the empty disc case receptacle 30. In such embodiments, approaching cases 12 can contact the case separator 93 and can be guided into proper position with respect to the wedge 23 by movement of the case separator 93 with the cases 12. By way of example only, the case separator 93 in the illustrated preferred embodiment is mounted upon a track extending between the empty disc case receptacle 30 and the wedge 23. As empty cases 12 exit the empty disc case receptacle 30, they first contact the case separator 93, which travels along the track and thereby properly positions each case 12 with respect to the tip 25 of the wedge 23. The case separator 93 can be biased toward the empty disc case receptacle 30 by one or more springs, magnets, hydraulic or pneumatic cylinders, or by any other biasing or positioning devices. Therefore, the case separator 93 can preferably return to a position adjacent to the empty disc case receptacle 30 after each case 12 has been conveyed to the wedge 23.

Although a track can be employed to enable movement of the case separator 93 between the empty disc case receptacle 30 and the wedge 23 as just described, one having ordinary skill in the art will appreciate that a number of other elements, devices, and structures can instead be used for this purpose. For example, the case separator 93 can be connected to a hydraulic or pneumatic cylinder or to a solenoid which move the case separator 93 back and forth between the empty disc case receptacle 30 and the wedge 23. As another example, the case separator 93 can be mounted to a belt or chain driven in a reciprocating fashion by a motor or other conventional driving device. Still other elements, devices, and structures can be used, each one of which falls within the spirit and scope of the present invention.

It should be noted that the above-described case guiding function performed by the case separator 93 in the illustrated preferred embodiment can be performed without also separating cases 12 approaching the wedge 23. Specifically, the structure (and alternatives) described above for properly positioning cases 12 as they approach the wedge 23 can be employed without separating the cases 12, if desired. In such cases, the wedge 23 preferably performs the function of case separation as will be described in greater detail below.

Although a moving case separator 93 is employed in the disc packaging apparatus 10 illustrated in the figures, it should be noted that the case separator 93 can instead be stationary. In other embodiments, no case separator 93 is used. In such embodiments, the cases 12 leaving the empty disc case receptacle 30 are preferably conveyed to, separated by, and opened by the wedge 23.

Preferably, the case separator 93 has a relatively thin and/or pointed tip 95 or edge which contacts the interface between the lid 14 and housing 13 of the case 12 and which can be forced between the lid 14 and housing 13 as the case 12 is moved toward the case separator 93. Following separation of the case by the case separator 93 (in those embodiments in which the case separator 93 is employed), the case 12 is moved toward the wedge 23 in order to open the case 12.

The manner in which cases 12 exit the empty disc case receptacle 30 can vary depending at least partially upon case size and shape. Therefore, some cases, can be ejected toward the case separator 93 to be separated thereby, while other cases can be ejected so that the cases 12 are at least partially supported by the case separator 93 (and are not separated thereby). To this end, some preferred embodiments of the present invention employ a case separator 93 that can be adjustably mounted so that the case separator 93 can be secured in different vertical positions with respect to approaching cases 12. In some positions, the case separator 93 serves to separate cases as described above, while in some lower positions, the case separator 93 functions only to support cases 12 until they reach the wedge 23.

The case separator 93 can be adjustably mounted in a number of different manners, such as by elongated vertical apertures in the case separator 93 through which fasteners can be passed for attaching the case separator to a frame or other assembly structure as described above. Alternatively, the case separator 93 can be adjustably mounted by connection to a vertically-oriented rail or pole. In such embodiments, the case separator 93 can have a base that is received around or within the rail or pole and that can be secured in different locations along the rail or pole in any conventional manner (e.g., setscrews, pins, clamps, and the like). Still other manners of adjustably connecting the case separator 93 in different vertical positions are possible, each one of which falls within the spirit and scope of the present invention.

In those embodiments in which a case separator 93 is not used to separate the lid 14 of a case 12 from the housing 13, the wedge 23 preferably separates the lid 14 of the case 12 from the housing 13 due to a similar wedging action. In such cases, the lid/housing interface of the case 12 is forced open by a tip 25 of the wedge 23. Although the tip 25 can be wedge-shaped or can otherwise have a pointed extremity which contacts the case 12 to force the case 12 open, the tip 25 can be rounded, blunt, or can take any other shape capable of causing the case 12 to open a when the case 12 is forced against the tip 25. One having ordinary skill in the art will appreciate that the shape of the tip 25 can vary depending upon the shape of the case 12 and lid/housing interface pressed upon by the tip 25 in order to force the lid 14 away from the housing 13 as discussed above. It should be noted that the part of the wedge 23 that first contacts and separates the lid 14 from the housing 13 need not be part of the inclined surface 41 subsequently used to further separate and open the case 12 as the case 12 is pushed against the wedge 23. Specifically, the tip 25 of the wedge 23 can be a separate element connected to or integral with the rest of the wedge 23, and can take any shape desired that is capable of forcing the lid 14 and housing 13 apart. However, the tip 25 is preferably a wedge-shaped end of the wedge 23 as also described above.

As just described, the force applied to the lid/housing interface by forcing the case 12 against the case separator 93 or the wedge 23 causes the lid 14 and housing 13 to separate from each other. Preferably, as the case 12 continues to move toward the inclined surface 41, the lid 14 is further separated from the housing 13 by being guided flier along the inclined surface 41.

It should be noted that in some embodiments of the present invention, the part of the wedge 23 that is used to separate the lid 14 from the housing 13 (when a case separator 93 is not employed for this purpose) can be the same element that is subsequently used to further open the lid 14 as the case 12 is further moved toward the wedge 23 as just described. Specifically, after separation of the lid 14 from the housing 13 by a portion of the wedge 23, the lid 14 can ride upon the same portion of the wedge 23 as the case 12 is moved toward the wedge 23, thereby causing the lid 14 to open further. Therefore, the wedge 23 in some embodiments of the present invention need not necessarily have an inclined surface at all. However, the element separating and opening the lid 14 in such embodiments is still considered to be a "wedge" because it acts to wedge the lid 14 away from the housing 13. As used herein and in the appended claims, the term "wedge" therefore refers to an element having any shape and size that is capable of opening the case 12 when the case 12 is forced against the wedge 23. Although the wedge 23 is preferably shaped as described with reference to the illustrated preferred embodiment of FIGS. 1–7, one having ordinary skill in the art will appreciate that a number of other wedge shapes can perform the same or similar function.

Therefore, in some embodiments of the present invention, the wedge 23 does not have any inclined surface. In other embodiments, one or more surfaces on the housing 13 and/or lid 14 define one or more inclined surfaces with respect to the housing 13 and/or lid 14. In still another embodiments, both the lid 14 and the housing 13 have surfaces that are angled with respect to the wedge 23.

The shape of the wedge 23 is dependent at least in part upon the shape of the cases 12 being separated and the lid/housing interface of such cases. In some embodiments, the lid/housing interface of the case 12 can present a relatively box-like profile to the wedge 23. In other embodiments, the lid/housing interface of the case 12 can have one or more surfaces that are angled, curved, or are otherwise shaped to assist in the wedging action described above. For example, some types of cases 12 have a recess 22 defined by the interface between the lid 14 and the housing 13 of the case 12. The walls of the recess 22 can be angled toward the case 12 or can form an outwardly-facing concave surface. Therefore, a tip (whether of the separator 95 or the wedge 23) can be received within the recess 22 of a closed case 12. By virtue of this case shape, the wedge 23 (or case separator 93) is better enabled to separate the lid 14 from the housing 13.

As indicated above however, the present invention is not limited to opening this or any other type of case. For example, the wedging action described above works with music-type jewel cases, cases with one or more lips at the lid/housing interface, and cases that present other profiles to the wedge 23 or case separator 93. The wedge 23 or case separator 93 can push against any portion of the lid/housing interface that can be forced to open the case 12. Furthermore, the inclined surface 41 can optionally be used to further open the case 12 after the lid/housing interface has been separated. As long as a case has two surfaces that can be separated by sliding, rotating, and other movement with sect to a wedge 23 or case separator 93, the wedging action of the present invention can be used to open the case.

In those embodiments of the present invention in which the wedge 23 has an inclined surface 41, the inclined surface can be oriented at any angle with respect to approaching cases 12 that can generate the opening wedging action described above. Preferably, this angle is an acute angle directed away from approaching cases 12. The inventor has discovered that superior case opening results can be generated with many cases by employing an inclined surface having an acute angle (directed away from approaching cases 12) of between 10 and 80 degrees. Better opening results are possible when this angle falls between 35 and 55 degrees. However, best case opening results have been generated when this angle is about 55 degrees.

As described above, the wedging action between the wedge 23 (and case separator 93, when employed) and the cases 12 occurs by movement of cases 12 toward the wedge 23 (and case separator 93). One having ordinary skill in the art will appreciate that the desired wedging action can be generated by any relative motion between the cases 12 and the wedge 23 or case separator. In particular, the case 12 need not necessarily move toward the wedge 23 or case separator 93 to generate the wedging action. In other embodiments, the case 12 is stationary and is preferably braced so that the wedge 23 and/or case separator 93 can be moved toward the case 12 to generate the wedging action. In still other embodiments, both the wedge 23 and the case 12 (or both the case separator 93 and the case 12) are moved toward one another for this same purpose. In such cases, the wedge 23 or case separator 93 can be mounted upon or otherwise connected to any driving device capable of moving the wedge 23 or case separator 93. The case separator 93 illustrated in the figures is one example of such an arrangement. By way of example only, the device can be an actuator, a hydraulic or pneumatic piston, a solenoid, a carriage or shuttle slidably and/or rotatably mounted upon a track, rail, or other guide, and the like. Any other element and device capable of moving the wedge 23 or case separator 93 (in a reciprocating or non-reciprocating fashion) toward the case 12 can instead be used and falls within the spirit and scope of the present invention.

With continued reference to the illustrated preferred embodiment of the present invention, after the case 12 has been opened, the case 12 preferably travels along the feed path to downstream stations, including a media disc insertion station 50. At this station, an insertion arm 51 with a grasping head 52 is preferably used to remove a disc 15 from a disc supply receptacle 53 (described in greater detail below). Preferably, once the arm 51 has control over a disc 15, it is then repositioned to place the disc 15 within the open disc case 12.

The disc supply receptacle 53 can have many different forms such as a walled structure, an area bounded partially or entirely by rods, a single rod, or any other structure or device capable of receiving and retaining multiple discs, including those described above with reference to the empty disc case receptacle 30. Regardless of the structures and elements used, the media disc insertion station 50 is preferably capable of gathering and feeding discs 15 to the cases 12. The disc supply receptacle 53 can be made of any suitable material, including but not limited to metal, plastic, wood, ceramic, and composites. Preferably, a disc feeding device 54 is used in conjunction with the supply receptacle to deliver discs 15 to the feed path of the cases 12 defined at least partially by the conveyor 16.

In one preferred embodiment, a vertical disc feeding device 54 is used within the supply receptacle 53 to supply the discs 15 to a position at which the arm 51 (or other disc manipulation device) can grasp and transport the discs 15, or at which the discs 15 can otherwise be moved or ejected to the cases 12. If a disc insertion device such as the arm 51 described above is used in conjunction with the disc receptacle 53 to deliver the discs 15 to the feed path, the disc insertion device 51 can be timed or otherwise triggered to operate responsive to motion or position of the conveyor 16, the driver driving the conveyor, or any other moving element of the machine (e.g., another feeding device 71 for feeding business cards or other material 74 as described below, the closing member 61 as also described below, the second conveyor 24, an indexer if one is used to drive the conveyor 16, etc.). In some embodiments, the disc insertion device 51 can be triggered to load discs into the open cases 12 by one or more sensors, such as mechanical trip sensors, optical sensors, weight sensors, and the like. In still other embodiments, the disc insertion device 51 can be triggered by a controller that operates part or all mechanisms of the apparatus 10 in a timed fashion.

Preferably, the insertion arm 51 is a conventional pick and place arm having a grasping head 52 that can grasp discs to then be moved. In one embodiment, the grasping head 52 is a suction cup supplied in a conventional manner with vacuum through one or more vacuum lines. A vacuum generator (not shown) is preferably used to create vacuum supplied to the vacuum cup. The suction generated through the vacuum cup is thereby used to grasp the disc 15 and is reduced to drop the disc 15. In other embodiments, the insertion arm 51 can be provided with one or more magnets (for discs having magnetically-responsive material), or fingers which can be used to grasp the discs 15. Still other conventional types of pick and place arms can be employed to grasp, transport, and drop or insert media discs into the open disc cases 12, each one of which falls within the spirit and scope of the present invention.

One having ordinary skill in the art will appreciate that numerous other devices can be used to insert discs 15 into the open cases 12. By way of example only, a shuttle adjacent to the conveyor 16 can shuttle back and forth to insert discs 15 into the open cases 12, a mechanism that drops discs 15 from a receptacle into the open cases 12, a conveyor that feeds discs into the open cases from a location above and/or adjacent to the conveyor 16, an ejector mechanism that ejects discs 15 into the open cases 12, and the like. Each of the alternative disc inserting devices can be timed or can otherwise be triggered to operate in the same manner as described above with reference to timing of the disc insertion arm 51.

In addition to the media disc insertion station 50, some embodiments of the present invention employ one or more additional insertion stations 70 located at any position adjacent to the conveyor 16 for inserting various items 74 such as business cards, another media disc, product literature, advertisement material(s), or any other object desired. The additional insertion station(s) 70 can take any of the forms described above with reference to the disc insertion station 50, and can operate much like the media disc insertion station 50. By way of example only, and with reference to the illustrated preferred embodiment, such additional media insertion stations can comprise an insertion arm 71 with a grasping head 72 to receive an item 74 from a receptacle 73, stack, conveyor, and the like. Once the arm 71 has control over the item 74, it is then preferably repositioned to place the item 74 into the open disc case 12.

After all items have been placed in the case 12, the case 12 preferably proceeds to a closing station 60 where a closing member 61 moves the lid 14 of the case 12 toward the housing portion 13 to close the case 12. The closing member 61 can take many forms such as a stamp, roll, guide rail, or wedge past or beneath which the cases 12 are moved by the conveyor 16, or actuatable devices such as one or more solenoids, motor-driven arms or fingers, pneumatic or hydraulic cylinders, and the like. Regardless of structure, the closing member 61 functions to move the lid 14 to a closed position as the case 12 passes by it or is otherwise located in the closing station 60. In the illustrated preferred embodiment, a closing member 61 is rotatably supported about a pivot to roll upon the lid 14 of the case 12 in order to close the case 12 as described above.

Some preferred embodiments of the present invention employ one or more guide rails 20 to hold the lid 14 of the disc case 12 in an open position or to at least partially assist in closing the disc case 12. For example, one guide rail 20 can be positioned adjacent to the inclined surface 41 and can be positioned to run along the feed path of disc cases 12 moved by the conveyor 16 to hold each disc case 12 in an open position. Once the disc case 12 is wedged open by the inclined surface 41, preferably the inside surface of the lid 14 rides upon the guide rail 20 until all materials are placed in the case 12. After all materials have been inserted in the case 12, the lid 14 preferably leaves the guide rail 20 to permit the lid 14 to be closed.

As another example, a guide rail 20 can be positioned adjacent to the conveyor 16 to at least partially assist in closing the case 12. Specifically, this guide rail 20 can push upon an exterior surface of the lid 14 to push it towards a closed position.

One having ordinary skill in the art will appreciate that other elements and devices can be employed to perform similar functions to the guide rails 20 just described. By way of example only, one or more walls, fingers, or other elements can be located adjacent to the conveyor 16 in order to control the movement of passing lids 14, whether to keep the lids 14 in an open position, to assist in closing the lids 14, or to otherwise change the position of each passing lid 14. Each one of these alternative elements and devices falls within the spirit and scope of the present invention.

Another type of station that can be included in the packaging apparatus 10 of the present invention is a station for unloading the packaged disc and case 12 from the conveyor 16. In some preferred embodiments, this station is located downstream of the case closing station 60. This unloading station 80 preferably has an element or mechanism that removes the full disc case 12 from the feed path or otherwise permits the full disc case 12 to leave the conveyor 16. This task can be performed by a pick and place arm such as those described above, a piston, an actuator, an aperture through which cases 12 fall to downstream operations as shown in FIGS. 1–6, by having the case 12 fall off of the end of the conveyor 16, or in any other manner desired. As illustrated, one preferred method uses an aperture located beneath the conveyor 16 to unload the disc cases 12.

In some preferred embodiments, the packaging apparatus 10 of the present invention has a single drive system (not shown) coupled to each station and to the conveyor 16. Alternatively, one of more of the stations can have a dedicated drive system or can share a drive system with one or more other stations. In some preferred embodiments, all stations employing one or more moving elements to move, open, load, and/or close cases 12 are mechanically connected to a single drive unit. By way of example only, this drive unit can be a motor driving the conveyor 16, the insertion arms 51, 71, and the disc case closing station 60 in any conventional manner, such as by gear sets, belt and pulley or sprocket and chain assemblies, and the like. In some more preferred embodiments, the drive unit of each station is electrically connected (by wire or wirelessly) to a conventional controller that operates each station. The controller can be a PC, a microprocessor, discrete logic circuitry, or any other electronics capable of controlling driving units. In yet another embodiment, the drive system includes a user-actuatable device (such as a hand-operated crank or wheel 91) for mechanically driving all or part of the packaging apparatus 10 without power. Thus, by turning the hand wheel 91, one or more stations as well as the conveyor 16 operate.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the claims.

I claim:

1. An apparatus for packaging a media disc into a case, the case having a housing to which a lid is coupled for movement between an open and a closed position, the apparatus comprising:

a conveyor moveable to convey the case along a feed path;

an inclined surface positioned to contact and generate initial separation between the lid and the housing of the case on the conveyor by relative movement between the conveyor and the inclined surface, the relative movement causing at least one of the case to be pushed in a direction toward and against the inclined surface and the inclined surface to be pushed in a direction toward and against the case to change the case from a state in which the case is closed to a state in which the lid is separated from the housing;

an arm positioned along the feed path for inserting the media disc into the case in the open position of the case; and a roll rotatably supported to contact the case along the feed path, the roll pressing the case towards the closed position.

2. The apparatus as claimed in claim 1, wherein the inclined surface is a surface of a wedge.

3. The apparatus as claimed in claim 2, wherein the wedge has a tip positioned to contact the case on the conveyor for separating the lid from the housing.

4. The apparatus as claimed in claim 1, wherein the conveyor comprises a rotary table.

5. The apparatus as claimed in claim 4, wherein the rotary table further comprises an index ring coupled to the table to incrementally move the cases along the feed path.

6. The apparatus as claimed in claim 1, further comprising a user-manipulatable actuator coupled to the conveyor for hand-operation of the conveyor.

7. The apparatus as claimed in claim 1, wherein the inclined surface is a surface of a wedge positioned to open the case via relative movement of the wedge and case.

8. The apparatus as claimed in claim 1, further comprising a case receptacle positioned adjacent to the feed path and adapted to hold a plurality of cases.

9. The apparatus as claimed in claim 8, wherein the conveyor is positioned to receive a case from the case receptacle.

10. The apparatus as claimed in claim 1, wherein the conveyor is a first conveyor, the apparatus further comprising a second conveyor adjacent to the inclined surface and positioned to transport cases to the first conveyor.

11. The apparatus as claimed in claim 10, further comprising a case receptacle positioned adjacent to the feed path and adapted to hold a plurality of cases.

12. The apparatus as claimed in claim 11, wherein the second conveyor is positioned to receive cases from the case receptacle.

13. The apparatus as claimed in claim 1, further comprising at least one rail positioned along the feed path to hold the lid of the case in an open position until the media disc is placed in the case.

14. The apparatus as claimed in claim 1, further comprising at least one guide rail positioned along the feed path to at least assist in moving the lid of the case toward a closed position.

15. The apparatus as claimed in claim 1, further comprising a media disc receptacle positioned along the feed path adjacent to the arm.

16. The apparatus as claimed in claim 1, further comprising a region along the feed path in which loaded cases are removed from the conveyor after closure of the loaded cases.

17. The apparatus as claimed in claim 16, wherein the conveyor has an aperture through which loaded cases are removed from the conveyor.

18. The apparatus as claimed in claim 1, further comprising at least one additional arm along the feed path, the arm being movable to insert at least one additional item into the case.

19. The apparatus as claimed in claim 1, further comprising recesses in the conveyor, the recesses adapted to hold the cases.

20. An apparatus for packaging a media disc into a case, the case having a housing to which a lid is coupled for movement between an open and a closed position, the apparatus comprising:

a conveyor moveable to convey the case along a feed path;

an inclined surface positioned to contact and open the case by a single continuous relative motion between the case and the inclined surface, the single continuous relative motion causing at least one of the case to be pushed in a direction toward and against the inclined surface and the inclined surface to be pushed in a direction toward and against the case to change the case from a state in which the case is closed to a state in which the lid is separated from the housing;

an arm positioned along the feed path for inserting the media disc into the case in the open position of the case; and a guide rail positioned along the feed path, the guide rail assisting to control the position of the lid relative to the housing.

21. The apparatus as claimed in claim 20, wherein the inclined surface is a surface of a wedge against which the case is forced on the conveyor.

22. The apparatus as claimed in claim 21, wherein the wedge has a tip positioned to contact and separate the lid from the housing by the single continuous relative motion between the conveyor and the inclined surface.

23. The apparatus as claimed in claim 20, wherein the conveyor comprises a rotary table.

24. The apparatus as claimed in claim 23, wherein the rotary table further comprises an index ring coupled to the table to incrementally move the cases along the feed path.

25. The apparatus as claimed in claim 20, further comprising a user-manipulatable actuator coupled to the conveyor for hand-operation of the conveyor.

26. The apparatus as claimed in claim 20, further comprising a case receptacle positioned adjacent to the feed path and adapted to hold a plurality of cases.

27. The apparatus as claimed in claim 26, wherein the conveyor is positioned to receive cases from the case receptacle.

28. The apparatus as claimed in claim 20, wherein the conveyor is a first conveyor, the apparatus further comprising a second conveyor positioned to transport the case from the inclined surface to the arm.

29. The apparatus as claimed in claim 20, further comprising a case receptacle positioned adjacent the feed path and adapted to hold a plurality of cases.

30. The apparatus as claimed in claim 28, wherein the first conveyor is positioned to remove a case from the case receptacle.

31. The apparatus as claimed in claim 20, further comprising at least one guide rail located along the feed path, the at least one guide rail positioned to hold the lid of the case in an open position until the media disc is placed in the case.

32. The apparatus as claimed in claim 20, wherein the at least one guide rail is positioned along the feed path to at least assist in rotation of the lid of the case toward a closed position.

33. The apparatus as claimed in claim 20, further comprising a media disc receptacle positioned along the feed path adjacent to the arm.

34. The apparatus as claimed in claim 33, wherein the media disc receptacle further comprises a second conveyor positioned to supply the media discs to the arm.

35. The apparatus as claimed in claim 20, further comprising a region along the feed path for removing loaded cases from the conveyor after the loaded cases have been closed.

36. The apparatus as claimed in claim 35, wherein the conveyor has an aperture through which the loaded cases can be removed.

37. The apparatus as claimed in claim 20, further comprising at least one additional arm along the feed path for inserting additional items into the case.

38. The apparatus as claimed in claim 20, further comprising recesses in the conveyor adapted to hold the cases.

39. An apparatus for opening a media disc case, the case having a housing to which a lid is coupled for movement between an open and a closed position, the apparatus comprising:

a conveyor; and an inclined surface positioned to contact the case, generate initial separation between the lid and the housing of the case, and open the case on the conveyor all by a single type of continuous relative movement between the conveyor and the inclined surface, the single type of continuous relative movement causing at least one of the case to be pushed in a direction toward and against the inclined surface and the inclined surface to be pushed in a direction toward and against the case to change the case from a state in which the case is closed to a state in which the lid is separated from the housing;

wherein at least one of the conveyor and the inclined surface is moveable relative to the other.

40. The apparatus as claimed in claim 39, wherein the inclined surface is a surface of a wedge.

* * * * *